US008511465B2

(12) United States Patent
Seelhofer

(10) Patent No.: US 8,511,465 B2
(45) Date of Patent: Aug. 20, 2013

(54) CLOSURE FOR THE METERED ADDITION OF A COMPONENT

(75) Inventor: Fritz Seelhofer, Lindau (CH)

(73) Assignee: Belcap Switzerland AG, Neuhausen am Rheinfall (CH)

( * ) Notice: Subject to any disclaimer, the term of this patent is extended or adjusted under 35 U.S.C. 154(b) by 707 days.

(21) Appl. No.: 12/747,232

(22) PCT Filed: Dec. 10, 2008

(86) PCT No.: PCT/CH2008/000525

§ 371 (c)(1),
(2), (4) Date: Jun. 10, 2010

(87) PCT Pub. No.: WO2009/073998

PCT Pub. Date: Jun. 18, 2009

(65) Prior Publication Data

US 2010/0258457 A1 Oct. 14, 2010

(30) Foreign Application Priority Data

Dec. 11, 2007 (CH) ..... 01923/07

(51) Int. Cl.
*B65D 25/08* (2006.01)

(52) U.S. Cl.
USPC ..... 206/219; 206/221; 206/222; 220/403; 426/112

(58) Field of Classification Search
USPC ..... 206/219, 221, 222; 220/403; 426/112
See application file for complete search history.

*Primary Examiner* — Sally Merkling
(74) *Attorney, Agent, or Firm* — CUSPA Technology Law Associates; Yi Li

(57) ABSTRACT

The closure includes a rotary dispenser cap (1), and is used for metering of a component in the content of a so-equipped mixing vessel (17) before use. It contains a separately filled folding container (3) which is held on its lower side by resilient spacer elements (7) over stationary piercing teeth (8) and which is pusable downword by means of rotating the rotary dispenser cap (1) which will screw down the press ring (2) and press the container (3) over the piercing teeth (8). The folding container (3) is thereby torn open. By further screwing down of the pressing ring (2), the folding container (3) is being squeezed and pressed out, so that its contents are mixed in the underlying container (17).

9 Claims, 10 Drawing Sheets

CLOSURE FOR THE METERED ADDITION OF A COMPONENT

This invention relates to a closure, which itself contains a component so that, when the closure is opened the first time, the contents are added into a mixing container which is equipped with this closure. The metering and mixing is therefore inevitable when the closure is opened the first time and thus before the first applying of the mixture.

There are already several closures, which for example comprise a capsule sealed with a foil on its underside, said foil is then cut open from below when the closure is opened, so that the capsule content falls down into the container. FR-25 69 666 shows an example of such a closure. The separate capsules which can be filled according to this system are quite limited in their volume when compared with the diameter of the closure. Also, the metering of pasty components is not possible with the know systems because they are only designed for liquid components which fall down into the underlying mixing container due to gravity alone. In the case of a pasty mass, however, or a very viscous component, the rapid and safe dropping down is not guaranteed.

It is the object of the present invention, based on this prior art, to provide an improved solution and offer a closure which can contain a much larger component quantity in relation to the cap diameter, whereby this component may also be viscous or even up to pasty, and this component will nevertheless reliably moved into the container which is equipped with this closure once the closure will be opened the first time.

This object is achieved by a closure having a rotatable dispenser cap for metering of a component into the content of a mixing container equipped with this closure before use, which closure comprises a separately filled folding container, which is held on its lower side by resilient spacer elements above stationary piercing teeth, and, by turning the rotatable dispenser cap and screwing downward a press ring, said folding container is being pressed onto the piercing teeth and by this pierced open, and hence by further screwing down of the press ring, the folding container is being squeezed and pressed out, whereby its content falls into the underlying mixing container.

Based on the drawings this fillable closure will be presented by way of example and described in more detail, and its function will be explained.

Shown is in

Figure 1:
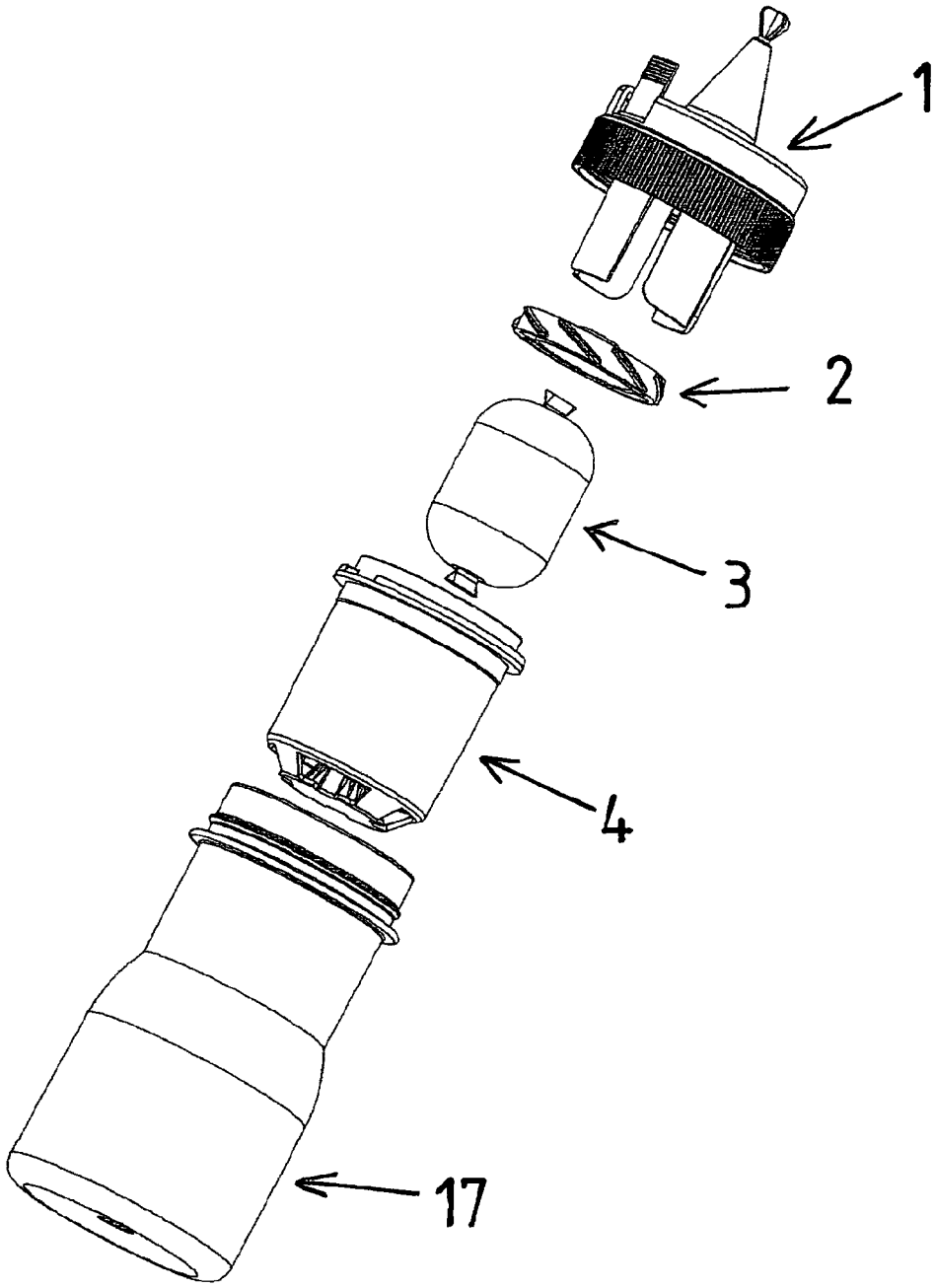
Figure 2:
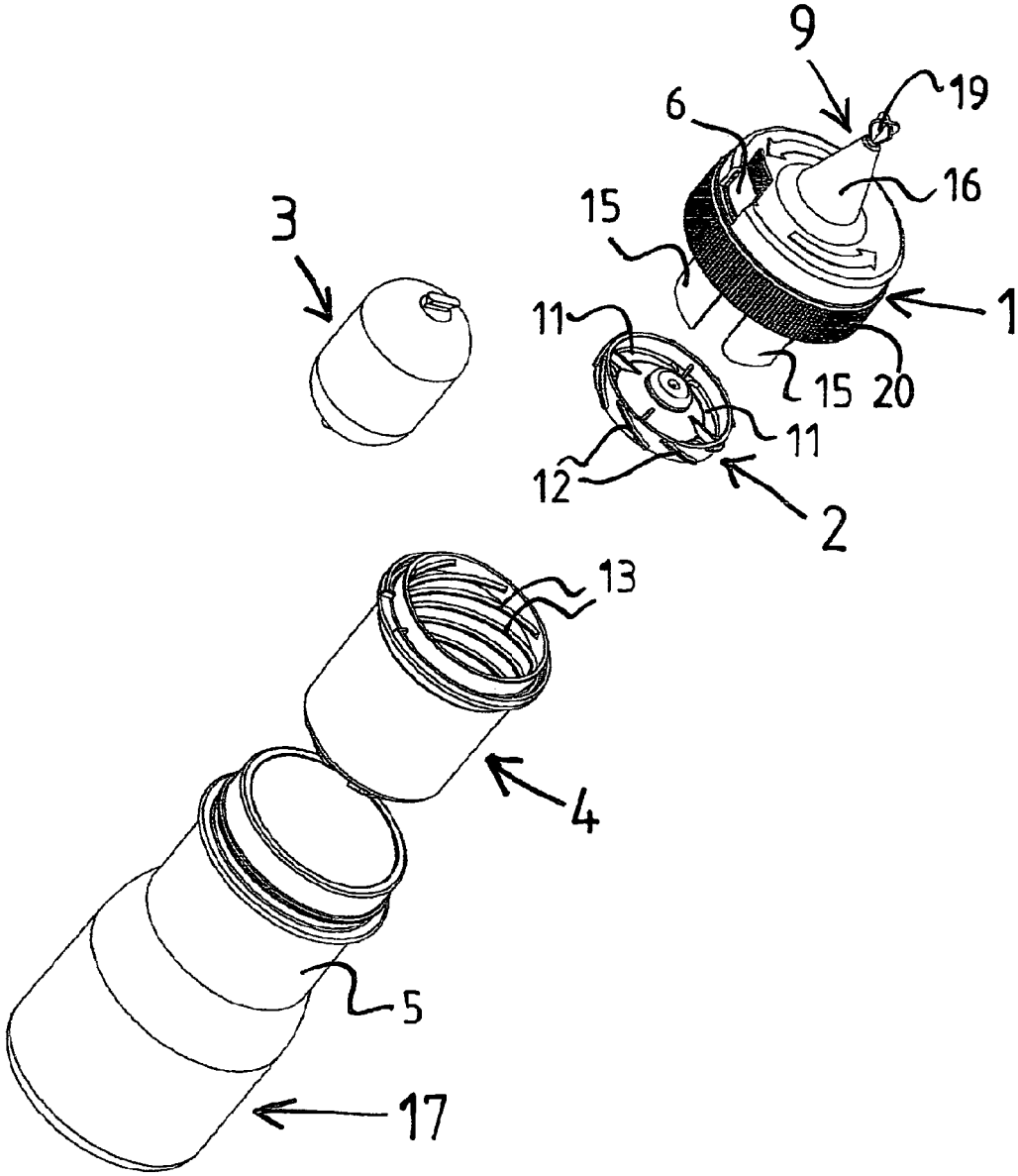
Figure 3:
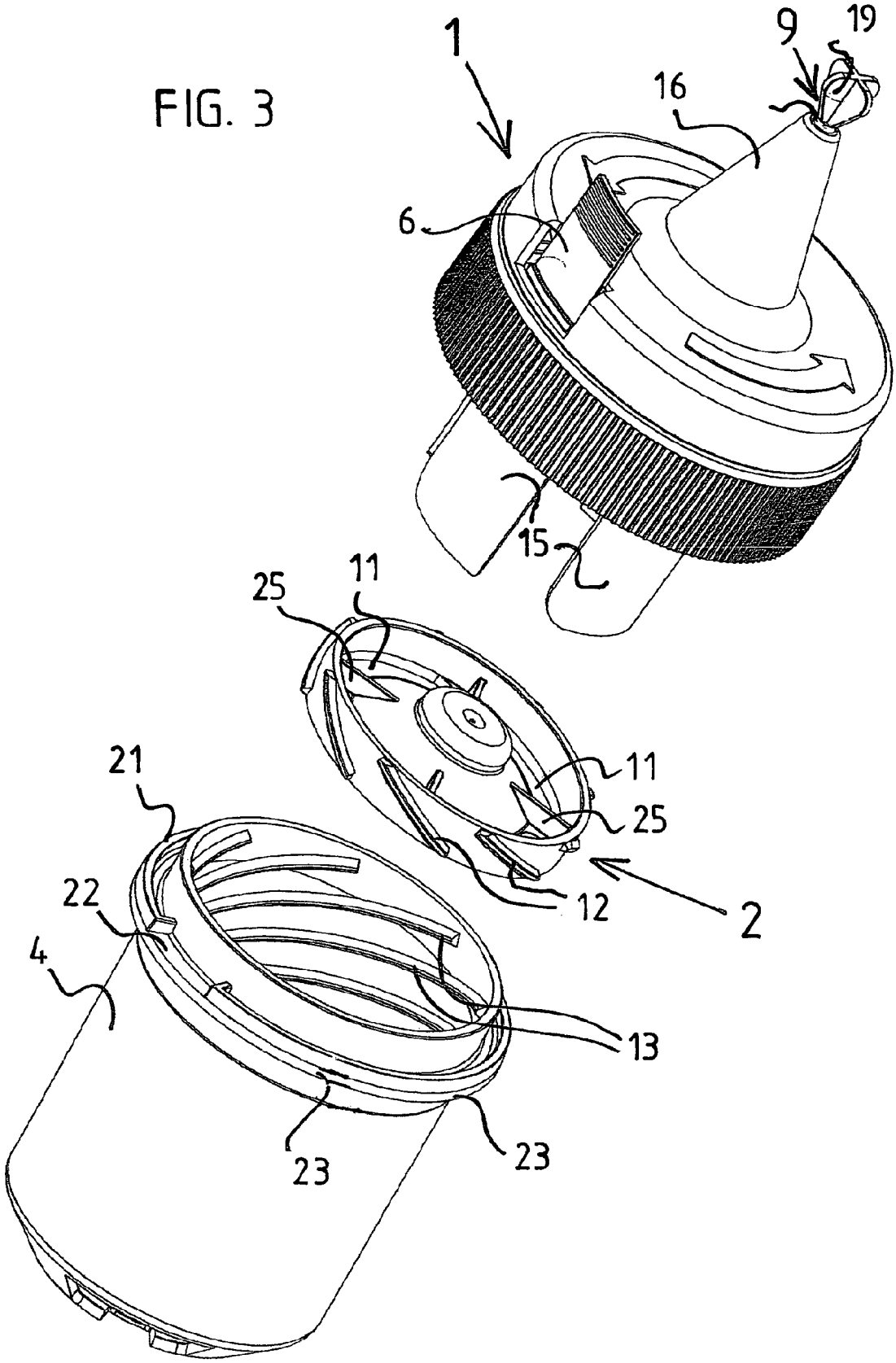
Figure 4:
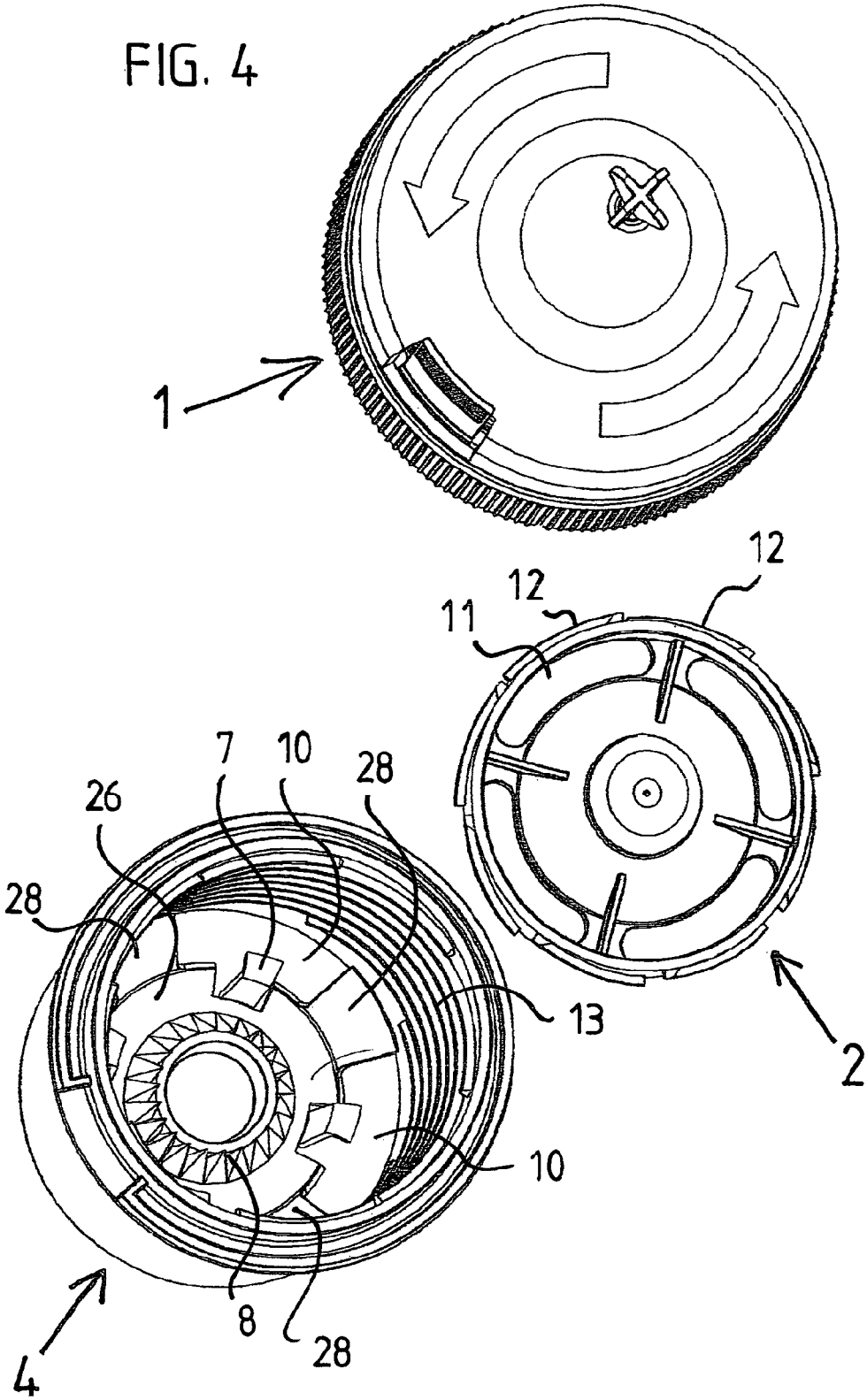
Figure 5:
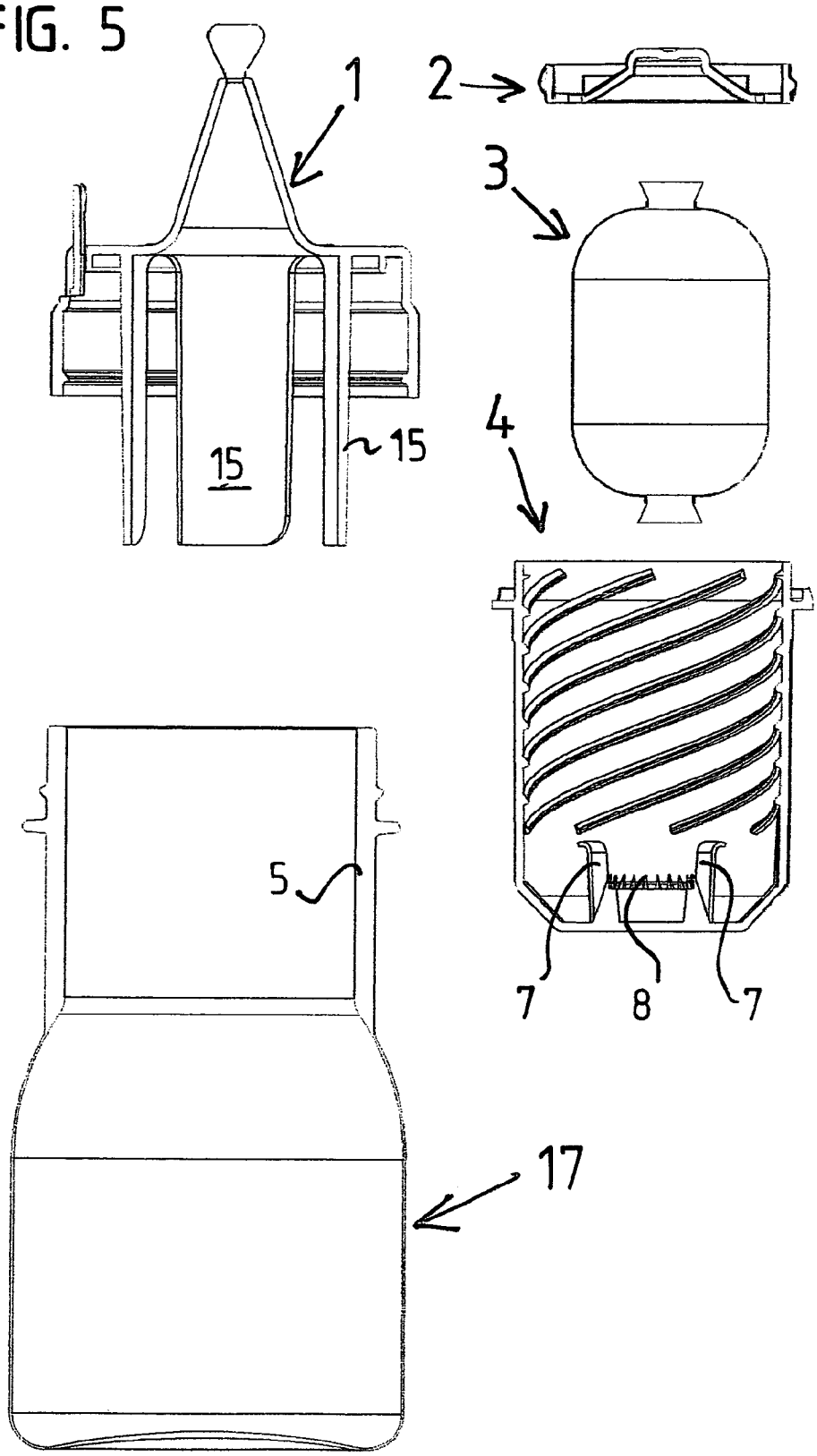
Figure 6:
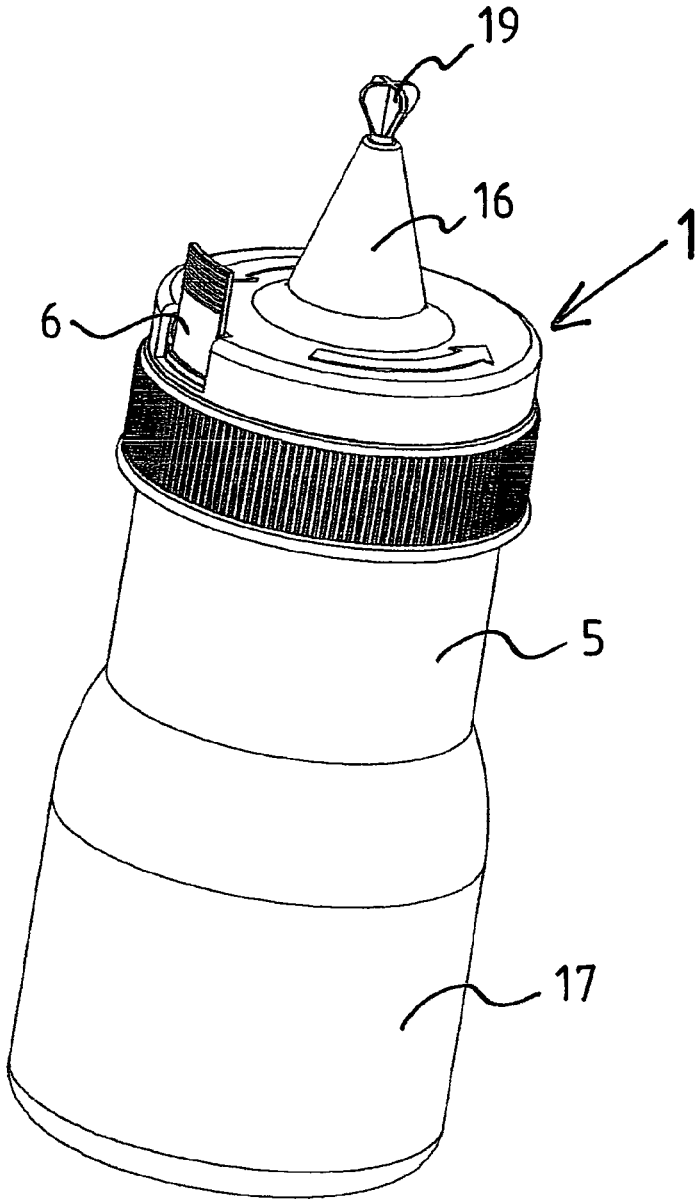
Figure 7:
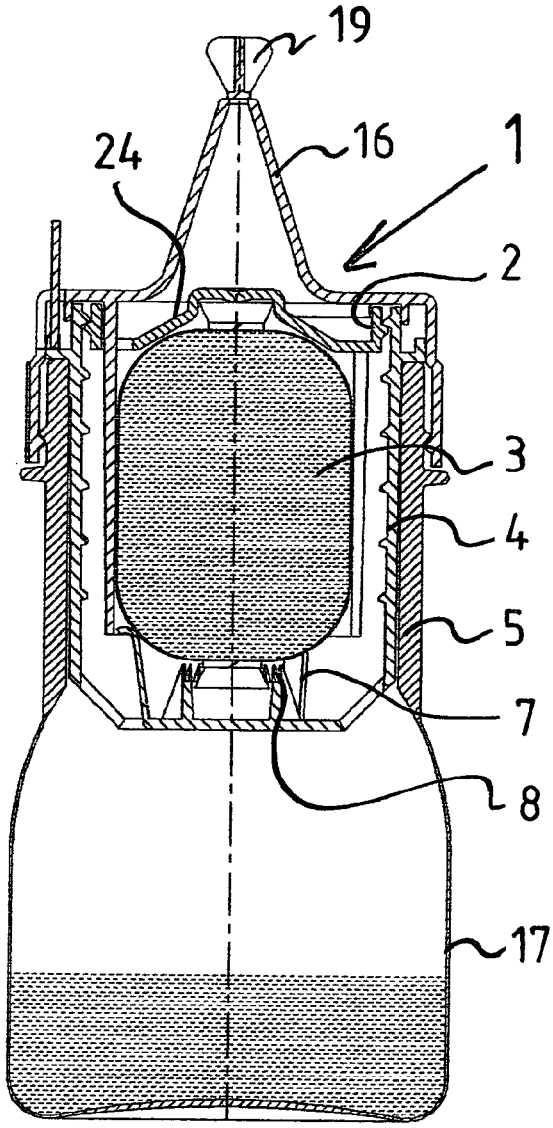
Figure 8:
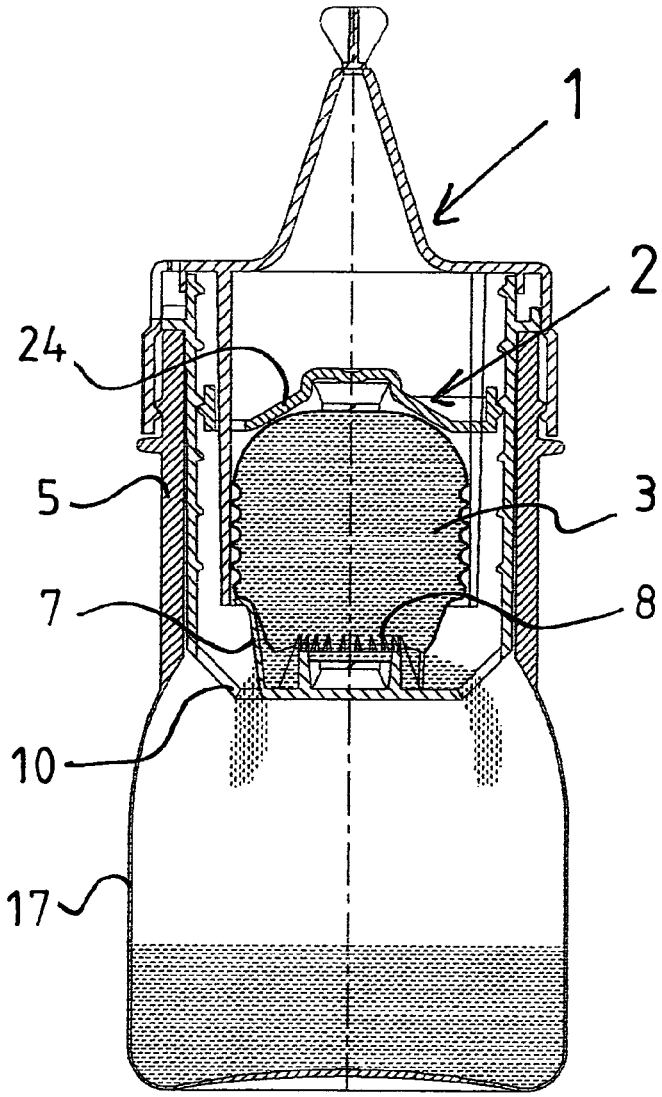
Figure 9:
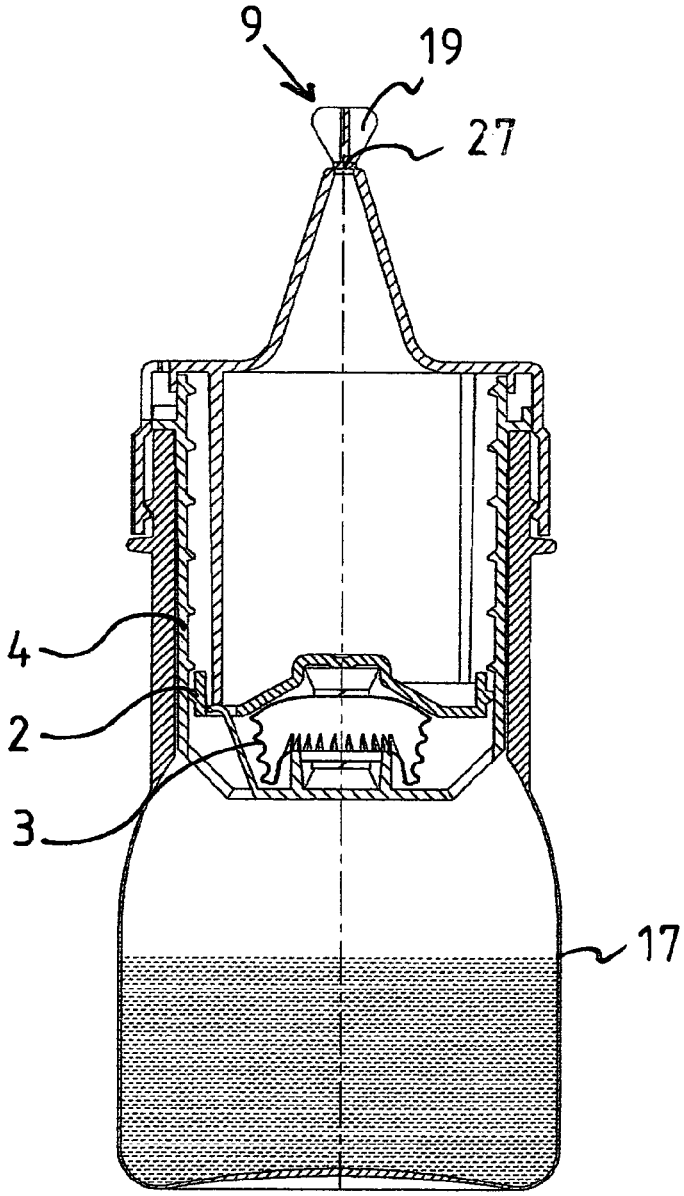
Figure 10:
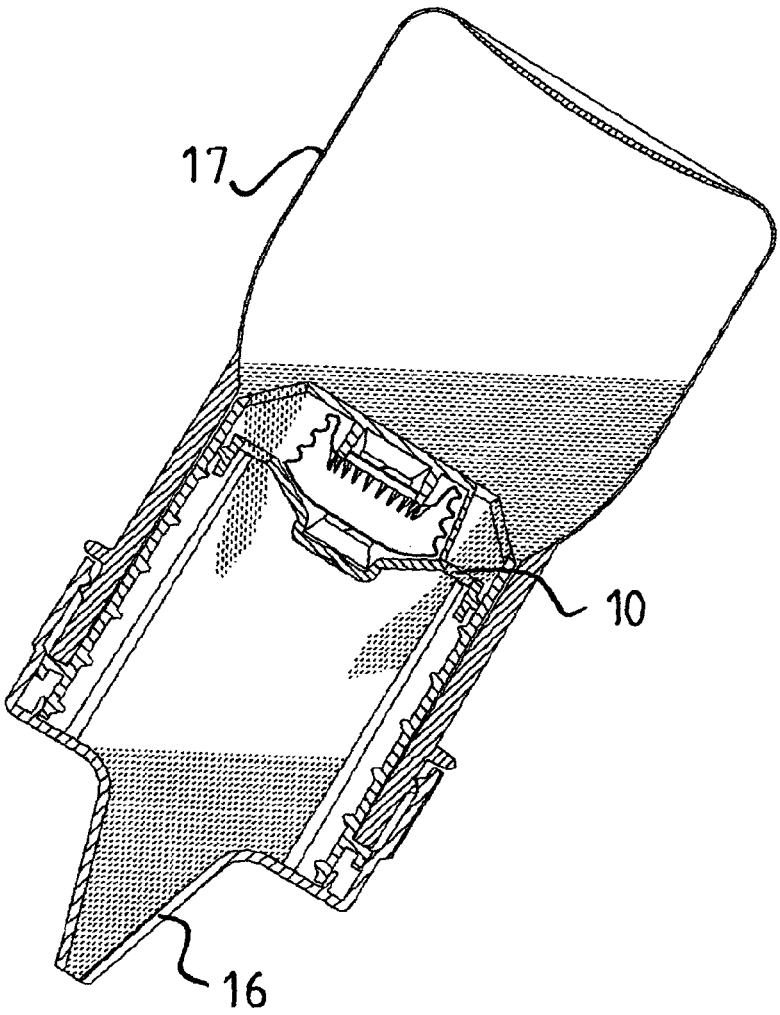

FIG. 1: The single parts of the closure that can be filled, in an exploded view while these parts are arranged on a common axis;

FIG. 2: The single parts arranged as shown in FIG. 1, seen from a different angle, and the collapsable container shifted away from the else common axis;

FIG. 3: The folding container sleeve, the pressing ring and the rotatable dispenser cap in an enlarged representation;

FIG. 4: The folding container sleeve, the pressing ring and the rotatable dispenser cap shown in an enlarged view, each seen from above;

FIG. 5: All single parts of the closure, presented in a longitudinal section view;

FIG. 6: The assembled closure, mounted on a mixing container;

FIG. 7: The assembled closure, mounted on a mixing container, in its initial position, shown in a longitudinal section view;

FIG. 8: The assembled closure, mounted on a mixing container, during the intial opening, that means while squeezing out the folding container;

FIG. 9: The assembled closure, mounted on a mixing container, with pressed out folding container;

FIG. 10: The assembled closure, mounted on a mixing container, while pouring out, after mixing the components and breaking off of the breaking tip of the spout.

First, FIG. 1 shows the different parts of the closure disposed on a common axis. Below one can see the mixing vessel 17, in which a first filling component is present in large quantity, and into which a second component should be mixed. Above the mixing vessel 17, a folding contianer sleeve 4 is shown, above which the actual folding container 3 is shown which contains the second componnet. This folding container 3 is filled separately, and afterwards inserted from above into the folding container sleeve 4. Above the folding container 3, a pressing ring 2 is shown, and eventually, at the top, the donor rotatable cap 1 with a funnel-shaped spout.

FIG. 2 shows these parts in a slightly different angle, namely, seen obliquely from above. As can be seen, the folding container sleeve 4, in its interior, has helical guide ribs 13, whereby this forms a left-handed thread. The press ring 2 fits into the interior of the folding container sleeve 4 and at its outer side, guide ribs 12 are formed which correspond to the guide ribs 13 inside the folding container sleeve 4. If the pressing ring is turned counter-clockwise inside the folding container sleeve 4, the pressing ring moves simultaneously within the interior of the folding container sleeve 4 downwards in the axial direction. As a variant, the inner side of the folding container sleeve 4 can be equipped with such guide ribs 13 which form a progressively increasing downward slope, and which fit to the guide ribs 12 on the outer side of the pressing ring 2. Thus, in the initial phase, a larger pressing force can be generated, which subsequently decreases for the mere and quick pressing out of the content and then gradually decreases. The drive of the pressing ring 2 is enacted by the actuators 15 which are formed on the bottom of the rotatable dispenser cap and extend downwards. These actuators 15, in the assembled state of the closure, fit into free recesses 11 in the pressing ring 2 so that the actuators 15 can exert a torque on it. The rotatable dispenser cap forms on its upper side a funnel-shaped spout 16, which extends into a break-off tip 9. The break-off tip 9 comprises a disk or thin-spot in the aperture of the spout and can be broken away. On the disc or thin-spot, a shear-handle with cross-shape—when seen in a section view—is formed. If this shear-handle is twisted in relation to the rotatable dispenser cap 1, the break-off tip 9 is sheared off, that is the disc or thin spot will be broken out of the aperture and the spout 16 will be opened at its front. The rotatable dispenser cap 1 can be clicked sealingly onto the top of the folding container sleeve 4, and for opening of the mounted closure, it is rotatable against the folding container sleeve 4. On the side of the rotatable dispenser cap 1, a locking element 6 as lock against rotation is mounted, which works as a tamper evidence. Only once this locking element 6 is pivoted away in the radial direction against the outside and hence broken away, the rotatable dispenser cap can be rotated on the foldable container sleeve 4. The rotatable dispenser cap 1 includes a fluted bezel 20 with corrugated surface, on which it can be grasped and turned. The folding container 3 is presented here in a laterally moved position in order to indicate that it will be filled separately and only then will be inserted from the top into the folding container sleeve 4. It is made of soft material made so that it is kinkable and foldable, and it forms a tubular bag or dose and is filled with a component and sealed, e.g. with a viscous or even paste-like component, as known and customary in the domain of tubular bag packaging. After filling the tubular bag it will be closed on both sides by welding and then inserted from the top into the folding container sleeve 4.

FIG. 3 shows the folding container sleeve 4, the pressing ring 2 and the rotatable dispenser cap 1 in an enlarged view, to make the details more easily recognizable. At the folding container sleeve 4 one can see the helical guide ribs 13 on its inner side. On its outer side, near the upper edge, this folding container sleeve 4 has a shoulder 23, and on its outer edge an upwardly projecting ring 21 is formed, after the manner of a parapet. This ring 21 is interrupted at one point and there is a gap 22. When the rotatable dispenser cap is attached, the rotatable dispenser cap does click with its lower edge onto the shoulder 23 and the locking element 6 is laying in the gap 22 on the ring 21. By this, the blocking element 6 prevents the rotatable dispenser cap 1 from turning on the folding container sleeve 4 as long as this blocking element 6 is not broken away. At the top of the dispenser cap it is formed into a funnel-like spout 16, which forms at its tip a break-off tip 9, which means that at the end of the spout 16, a disc 27 or thin spot can be broken away from the aperture of the spout. On this disc 27 there is a shear-off handle 19. By turning this shear-off handle 19, the disc 27 or thin spot will be broken out of the spout-aperture, and the flow through the spout is released. Further, the press ring 2 is shown. This is a short tube section, having on its outer side guide elements 12 which fit to the guide ribs 13 in the interior of the folding container sleeve 4. Inside the press ring 2, a curved pressing cap 24 is arranged, which is held by four radial webs 25. Between the outer edge of the pressing cap 24 and the press ring 2, there are free passways 11 in which the actuators 15 fit, which are arranged at the lower end of the rotatable dispenser cap 1, and extending downward.

FIG. 4 shows the folding container sleeve 4, the compression ring 2 and the rotatable dispenser cap 1 in an enlarged view, seen from above. At the lower end of the folding container sleeve 4, which means at its lower edge 18, a plate-shaped bottom 26 can bee seen which has upwardly extending annularly arranged piercing teeth 8. Outside of the bottom 26 there are free passes 10 formed and the bottom 26 is held by four bridges 28, of which three are visible here. At the bottom 26 there are also four upwardly extending resilient spacing elements 7 formed, which are angled at the top. These spacing elements 7 hold the tubular bag-like folding container 3 in a position above the piercing teeth 8. If, however, by rotation of the rotatable dispenser cap 1, the press ring 2 moves downward in the folding container sleeve 4, the folding container 3 will push these spacing elements 7 outward to the side and the folding container 3 is pressed over the piercing teeth 8, which will pierce open its bottom leads.

In FIG. 5, all parts of the closure are presented in a longitudinal section. One recognizes in particular the actuators 15 on the rotatable dispenser cap 1, and the arrangement of the resilient spacing elements 7 and the piercing teeths 8 on the folding container sleeve 4. In FIG. 6, the closure is assembled and mounted on a mixing vessel 17, and in FIG. 7, this assembled and mounted closure is shown in a longitudinal section view, in its initial position. From this figure one can see the position of the inserted folding container 3, which is now held above the piercing teeth 8 by the resilient spacer elements 7. The pressing ring 2 is located at the top of the folding container sleeve 4 and its press cap 24 is tightly fitting to the top of the folding container 3.

FIG. 8 shows the assembled closure mounted on a mixing vessel 17 during the squeezing out of the folding container 3. The rotatable dispenser cap 1 is rotated counterclockwise when seen from above, and the actuators 15 cause the press ring 2 to turn likewise. This causes the press ring 2 to move downard within the foldable container sleeve 4, while the folding container 3 is pressed down in the folding container sleeve 4 with its press cap 24, while the resilient spacing elements 7 are being pushed away to the outside. Finally, the folding container 3 is pressed over the underlying piercing teeth 8, which slits open the folding container 3. Upon further rotation of the rotating dispenser cap 1, the press ring 2 and its press cap 24 respectively squeeze the folding container 3 and press its content through the recesses 10, after which the content falls down into the mixing vessel 17, even if the content is of a pasty consistency. In FIG. 9, the final state of the pressing out of the folding container 3 is shown. The press ring 2 has now reached the bottom of the folding container sleeve 4 and the folding container 3 is completely flattened. The content of the folding container 3 is now at the bottom of the mixing vessel 17 and is mixed with the contents of it. Now, the mixing vessel 17 can be taken as needed and shaked well, because the closure is still tight to the outside, so then, the two components are intimately mixed, where such the achievement of such an active mixture is required by shaking.

After that, the shear-off handle 19 on the breaking top 19 will be gripped and turned and the disc 27 or thin spot on the front end of the spout 16 will be broken out. Then the mixing vessel 17 can to be overthrown, what is shown in FIG. 10. Here now, the mixed liquid contents flow through the openings 10 on the folding container sleeve 4 in the rotatable dispenser cap 1, and through the spout 16 to the outside.

The invention claimed is:

1. Closure having a rotatable dispenser cap (1) for metering of a component into the content of a mixing vessel (17) equipped with this closure before use, which closure comprises a separately filled folding container (3), which is below held by resilient spacer elements (7) above at least one stationary piercing tooth (8), and, by turning the rotatable dispenser cap (1) and screwing downward a press ring (2), said folding container (3) is being pressed onto the at least one piercing tooth (8) and by this pierced open, and hence by further screwing down of the press ring (2), the folding container (3) is being squeezed and pressed out, whereby its content is moved into the underlying mixing vessel (17).

2. Closure having a rotatable dispenser cap (1) for metering of a component into the content of a mixing vessel (17) equipped with this closure before use according to claim 1, consisting of a rotatable dispenser cap (1) with funnel-shaped spout (16) with tip (9) that can be broken off, which tip has on its underside at least one actuator (15), further comprising a folding container sleeve (4), to which the rotatable dispenser cap (1) can be rotatably sticked, and for receiving a foldable container (3) made from soft material and to be separately filled with a filling component and to be inserted into the spout (5) of an associated mixing vessel (17), whereby the folding container (3) rests on resilient spacer elements (7) arranged at the bottom of said folding container (3) and is held above at least one piercing tooth (8) which is arranged on the lower edge (18) of the sleeve, and that the folding container (3) is impinged from above by a press ring (2), which by means of engaging in it with at least one actuator (15) of the rotatable dispenser cap (1), is screwed down along of helical guide grooves (13) on the inner side of the folding container sleeve (4), so that the folding container (3), by bending the resilient spacer elements (7) to the side, is pressed onto the at least one piercing tooth (8) and therefore pierced open and be pressed out by the press ring (2), so that its contents is moved into the underlying mixing vessel (17).

3. Closure having a rotatable dispenser cap (1) for metering of a component into the content of a mixing vessel (17)

equipped with this closure before use according to claim 2, wherein the rotatable dispenser cap (1) comprises a break-off locking element (6) for preventing unwanted twisting of the rotatable dispenser cap (1) on the folding container sleeve (4) when the rotatable dispenser cap (1) is mounted onto it, said locking element (6) engages in a recess in the folding container sleeve (4), so that the rotatable dispenser cap (1) is only rotatable after breaking off of the locking element (6) on the folding container sleeve (4).

4. Closure having a rotatable dispenser cap (1) for metering of a component into the content of a mixing vessel (17) equipped with this closure before use according to claim 1, characterized in that the rotatable dispenser cap (1) on its upper side forms funnel-shaped spout (16) which extends into a breaking tip (9), which includes a disc (27) or thin spot to be broken off from the aperture of the spout, and whereby a shear off handle (19) is formed on said disc (27) or thin spot.

5. Closure having a rotatable dispenser cap (1) for metering of a component into the content of a mixing vessel (17) equipped with this closure before use according to claim 1, characterized in that the rotatable dispenser cap (1) comprises a rotary handle (20) with a corrugated surface.

6. Closure having a rotatable dispenser cap (1) for metering of a component into the content of a mixing vessel (17) equipped with this closure before use according to claim 1, characterized in that the folding container sleeve (4) forms a shoulder (23) at its upper end, and at the outer edge of said shoulder (23) a parapet-like upwardly projecting ring (21) is formed, interrupted by a gap (22), wherein the locking element (6) at the rotatable dispenser cap (1) engages in this gap (22) as lock against rotation in order to form a tamper evidence when the rotatable dispenser cap (1) is mounted.

7. Closure having a rotatable dispenser cap (1) for metering of a component into the content of a mixing vessel (17) equipped with this closure before use according to claim 1, characterized in that the folding container (3) is designed as a filled up tubular bag or filled up dose.

8. Closure having a rotatable dispenser cap (1) for metering of a component into the content of a mixing vessel (17) equipped with this closure before use according to claim 1, characterized in that the folding container sleeve (4) is sealingly pressable into the socket (5) of an associated mixing vessel (17).

9. Closure having a rotatable dispenser cap (1) for metering of a component into the content of a mixing vessel (17) equipped with this closure before use according to claim 3, characterized in that the inside of the folding container sleeve (4), guide ribs (13) are formed which have a progressively increasing downward slope, and which fit into the guide ribs (12) on the outside of the press ring (2).

* * * * *